US010386760B2

(12) United States Patent
Nakajima et al.

(10) Patent No.: US 10,386,760 B2
(45) Date of Patent: Aug. 20, 2019

(54) FIXING UNIT INCLUDING A PORTION-TO-BE-ENGAGED PROVIDED ON AN OPENABLE MEMBER, THE PORTION-TO-BE-ENGAGED BEING SPACED FROM OR ENGAGED WITH AN ENGAGING PORTION BASED ON MOVEMENT OF THE OPENABLE MEMBER

(71) Applicant: CANON KABUSHIKI KAISHA, Tokyo (JP)

(72) Inventors: Keita Nakajima, Mishima (JP); Fumiki Inui, Mishima (JP); Kazushi Nishikata, Tokyo (JP); Koichi Yamada, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/885,911

(22) Filed: Feb. 1, 2018

(65) Prior Publication Data

US 2018/0224780 A1 Aug. 9, 2018

(30) Foreign Application Priority Data

Feb. 8, 2017 (JP) ..... 2017-021099

(51) Int. Cl.
*G03G 15/20* (2006.01)

(52) U.S. Cl.
CPC ..... *G03G 15/2035* (2013.01); *G03G 15/2028* (2013.01)

(58) Field of Classification Search
CPC ..... G03G 15/2035; G03G 15/2028
USPC ..... 399/122, 124, 322
See application file for complete search history.

(56) References Cited

U.S. PATENT DOCUMENTS 8,725,039 B2 * 5/2014 Tanda ..... G03G 15/2035 399/122
9,075,386 B2 7/2015 Uchida et al.
9,557,702 B2 1/2017 Uchida et al.

FOREIGN PATENT DOCUMENTS

JP 2003-295671 A 10/2003
JP 2004-102043 A 4/2004
JP 2008-151922 A 7/2008
JP 2014-092706 A 5/2014

* cited by examiner

*Primary Examiner* — William J Royer
(74) *Attorney, Agent, or Firm* — Venable LLP

(57) ABSTRACT

A fixing unit includes a fixing portion including a rotatable heating member and a rotatable pressing member, a feeding portion including a first rotatable member and a second rotatable member, a main assembly, an openable member rotatably provided to the main assembly through a shaft and a bearing portion, an urging member, an engaging portion, and a portion to be engaged. The openable member has a rotation center provided at a position at which a direction of moment acting on the openable member by an urging force of the urging member is the same as a direction in which the openable member opens. The bearing portion includes an elongated hole having a long axis extending along an urging direction of the urging member.

17 Claims, 12 Drawing Sheets

FIXING UNIT INCLUDING A PORTION-TO-BE-ENGAGED PROVIDED ON AN OPENABLE MEMBER, THE PORTION-TO-BE-ENGAGED BEING SPACED FROM OR ENGAGED WITH AN ENGAGING PORTION BASED ON MOVEMENT OF THE OPENABLE MEMBER

CLAIM TO PRIORITY

This application claims the benefit of Japanese Patent Application No. 2017-021099 filed on Feb. 8, 2017, which is hereby incorporated by reference herein in its entirety.

BACKGROUND OF THE INVENTION

Field of the Invention

The present invention relates to a fixing unit (fixing device) mountable to an image forming apparatus, such as an electrophotographic copying machine or an electrophotographic printer.

In the copying machine or printer of an electrophotographic type, the fixing unit for fixing a toner image on a recording material is mounted.

As an example of the fixing unit, there is also a known device in which a fixing portion, and a first roller and a second roller, for forming a nip in cooperation with the first roller, which are provided downstream of the fixing portion with respect to a recording material feeding direction and in which the recording material fed from the fixing portion, is fed through the nip and then is discharged to an outside of the fixing unit.

In the fixing unit, including the above-described fixing portion and a feeding portion, improvement in jam clearance, in a case when a jam of the recording material occurs, has been required.

Japanese Laid Open Patent Application 2014-92706 discloses a fixing unit in which, in order to improve jam clearance in the case when the jam occurs in a main body of the fixing unit, a first roller is rotatably supported by a recording material guide unit provided rotatably to a device main assembly, and a second roller and a spring for urging the second roller against the first roller are provided in the device main assembly. During the jam clearance, the guide unit is opened relative to the device main assembly, so that the nip between the first roller and the second roller is opened.

FIG. 15 shows a fixing unit (fixing device) including a fixing portion, a feeding portion, and a guide unit provided rotatably to the fixing unit for performing jam clearance.

In a fixing unit 200 shown in FIG. 15, a toner image T is fixed on a recording material S in a nip N1 between a cylindrical film 201 and a pressing roller 202, which are provided in a fixing portion 200B. Then, the recording material S fed from the fixing portion 200B is fed through a nip N2 between a first roller 203 and a second roller 204, which constitute a feeding portion 200C.

In a case when a guide unit 200D is rotatably provided in a device main assembly 200A, it would be considered that a rotation center 221 of the guide unit 200D is provided on an outside or an inside of an urging direction E of a spring 206. Here, the outside refers to a side downstream of the nip N2 with respect to a recording material feeding direction X. The inside refers to a side upstream of the nip N2 with respect to the recording material feeding direction X.

As indicated by a solid line, in the case when the rotation center 221 of the guide unit 200D is provided outside of the urging direction E, the following advantage and disadvantage are provided.

Advantage: By pressure application with the spring 206, a moment in a closing direction indicated by an arrow acts on the guide unit 200D.

Disadvantage: A rotation center position of the guide unit 200D is in the outside of the urging direction E of the spring 206, and, therefore, a device size is increased.

On the other hand, as indicated by a broken line, in a case when the rotation center 221 of the guide unit 200D is provided inside of the urging direction E, the following advantage and disadvantage are provided.

Advantage: A rotation center position of the guide unit 200D is in the inside of the urging direction E of the spring 206, and, therefore, a device size is decreased.

Disadvantage: By pressure application with the spring 206, a moment in an opening direction indicated by an arrow acts on the guide unit 200D, and, therefore, there is a need to provide a means for supporting opening of the guide unit 200D.

As described above, even when the rotation center 221 of the guide unit 200D is provided outside or inside of the urging direction E of the spring 206, the disadvantages arise.

SUMMARY OF THE INVENTION

A principal object of the present invention is to provide a fixing unit that is small in device size and capable of suppressing opening of an openable member.

According to one aspect, the present invention provides a fixing unit comprising a fixing portion including a rotatable heating member and a rotatable pressing member to form a first nip in cooperation with the rotatable heating member to fix an image on a recording material by heating the recording material carrying the image while nipping and feeding the recording material, a feeding portion provided downstream of the fixing portion with respect to a recording material feeding direction and including a first rotatable member and a second rotatable member to form a second nip in cooperation with the first rotatable member to nip and feed the recording material fed from the fixing portion, a main assembly rotatably supporting the rotatable heating member, the rotatable pressing member and the first rotatable member, an openable member rotatably supporting the second rotatable member and rotatably supported on the main assembly by a shaft and a bearing portion supporting the shaft, wherein, when the openable member is opened relative to the main assembly, the second rotatable member is spaced from the first rotatable member, and, when the openable member is closed relative to the main assembly, the second rotatable member contacts the first rotatable member, an urging member provided in the main assembly to urge the first rotatable member toward the second rotatable member, an engaging portion provided in the main assembly, and a portion to be engaged provided on the openable member, wherein the portion to be engaged is spaced from the engaging portion when the openable member is opened, and is engaged with the engaging portion when the openable member is closed, wherein the openable member has a rotation center provided in a position where a direction of moment acting on the openable member by an urging force of the urging member is the same as a direction in which the openable member opens, and wherein the bearing portion includes an elongated hole having a long axis extending along an urging direction of the urging member.

Further features of the present invention will become apparent from the following description of exemplary embodiments with reference to the attached drawings.

Figure 9:
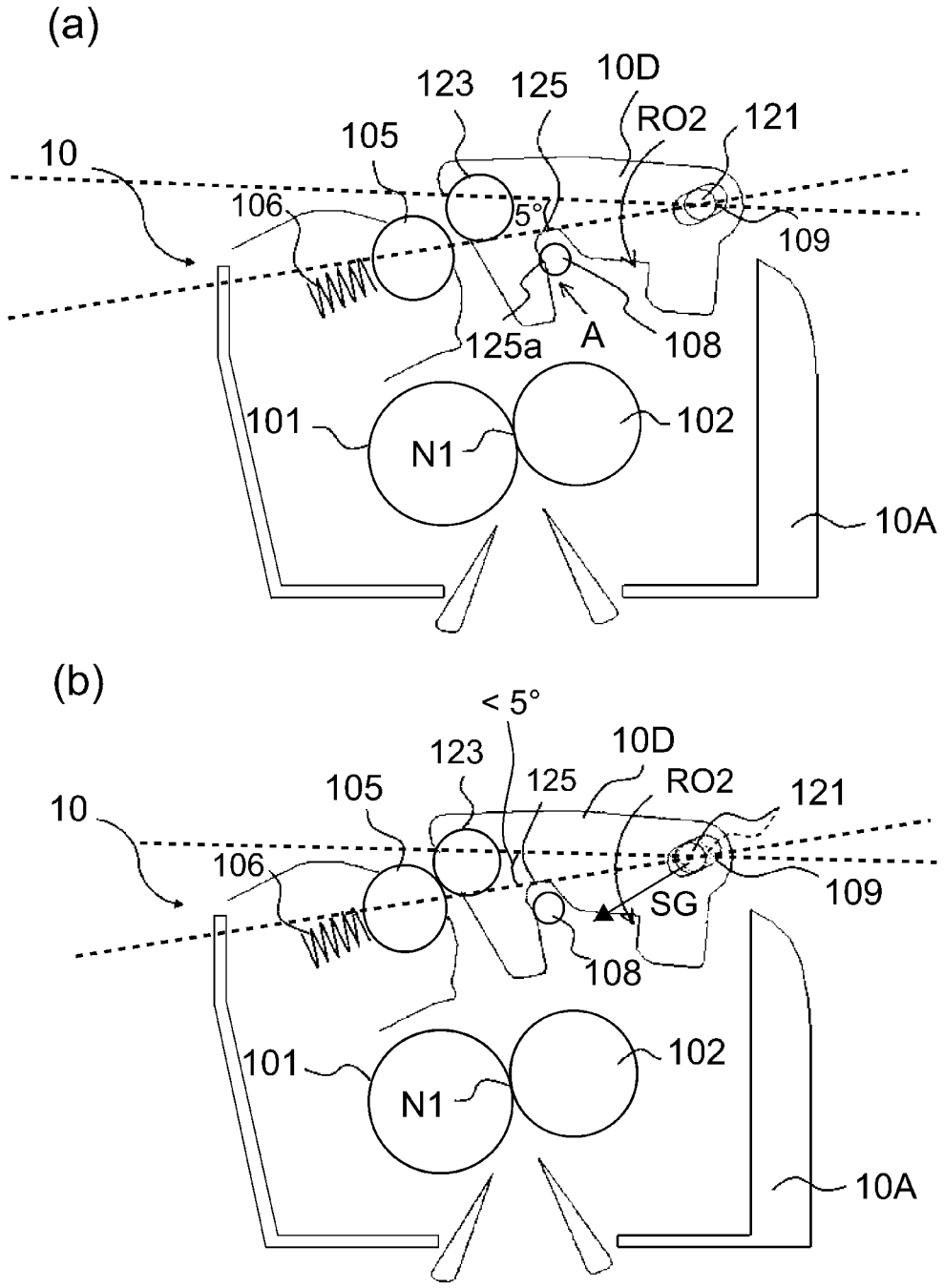

Parts (a) and (b) of FIG. 9 are sectional views showing schematic structures of the fixing unit when the open angles of the guide unit are five degrees and less than five degrees, respectively.

Figure 10:
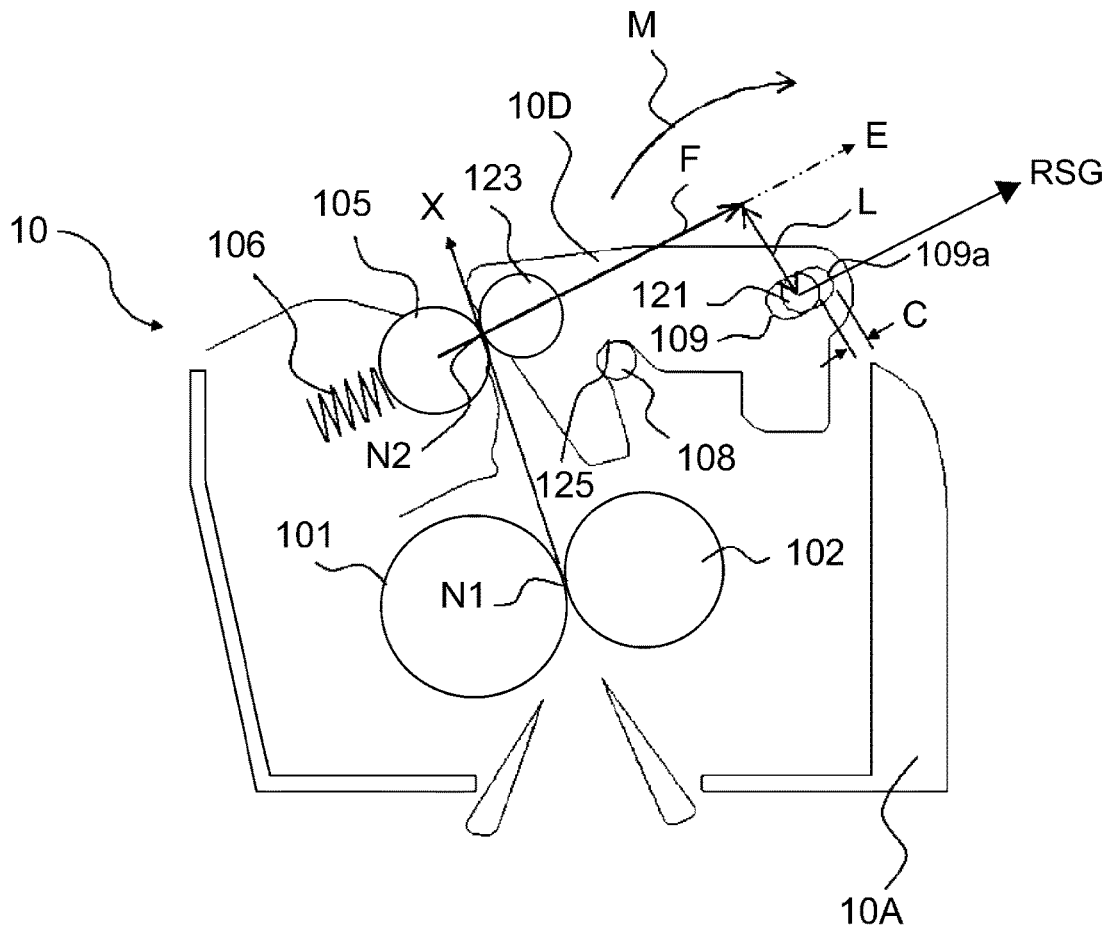

FIG. 10 is a sectional view showing a schematic structure of the fixing unit when the open angle of the guide unit is zero degrees.

Figure 11:
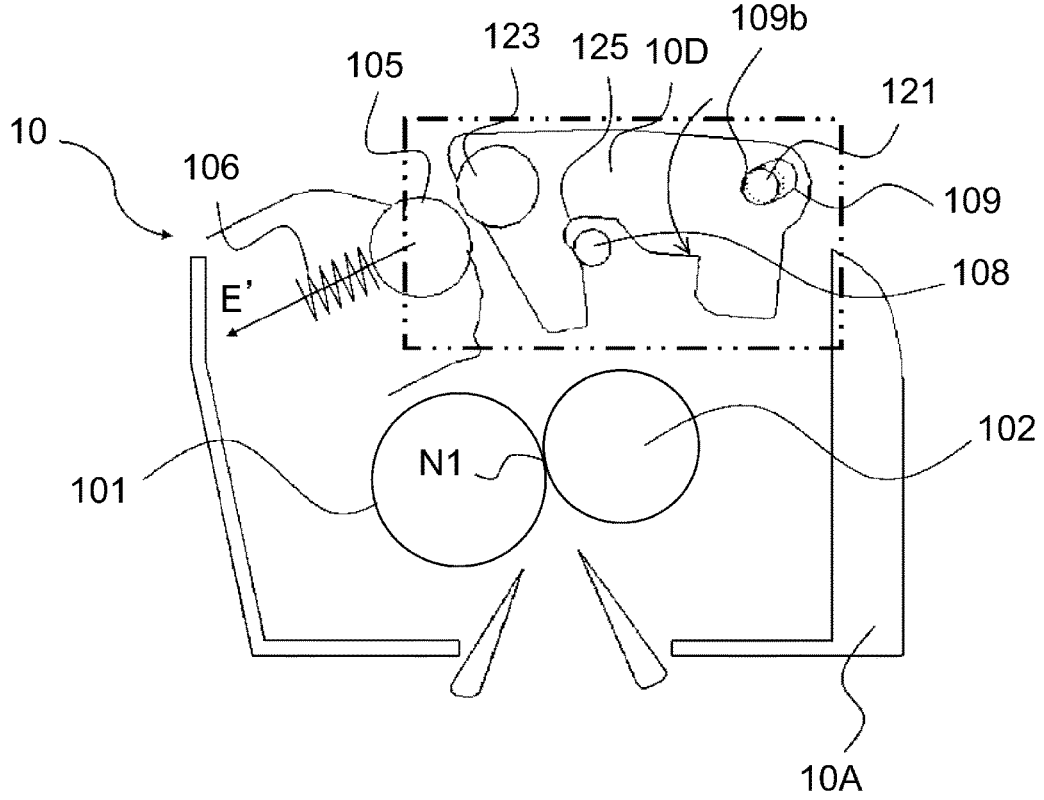

FIG. 11 is a sectional view showing a schematic structure of a fixing unit according to Embodiment 3.

Figure 12:
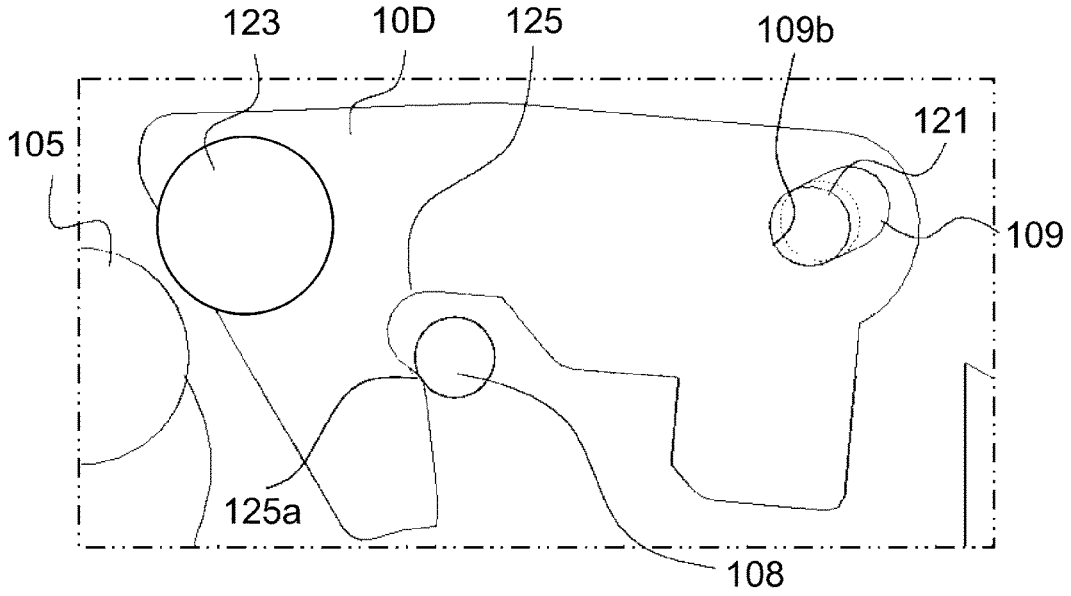

FIG. 12 is an enlarged view of a region shown in FIG. 11 by a chain double dashed line.

Figure 13:
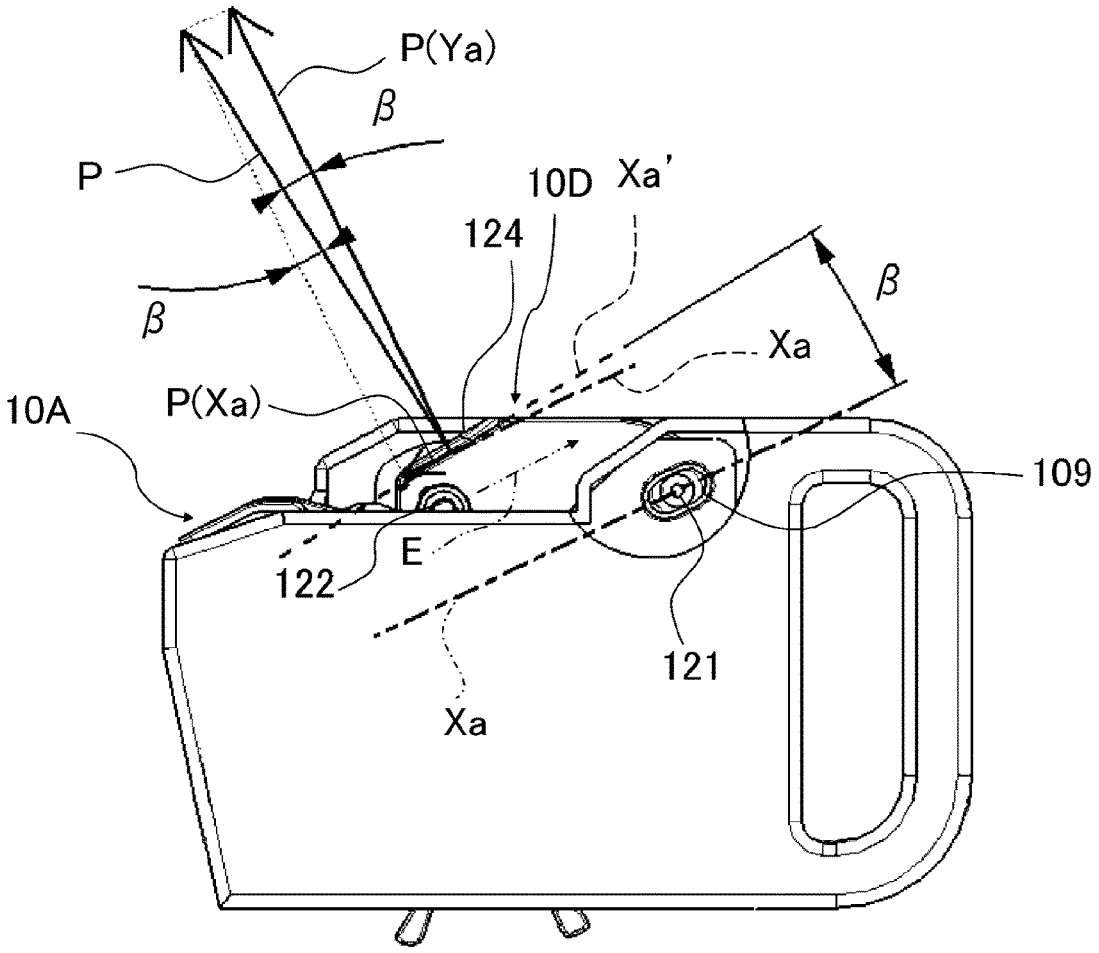

FIG. 13 is a side view of the fixing unit according to Embodiment 3 on a side where a grip portion of the fixing unit is provided.

Figure 14:
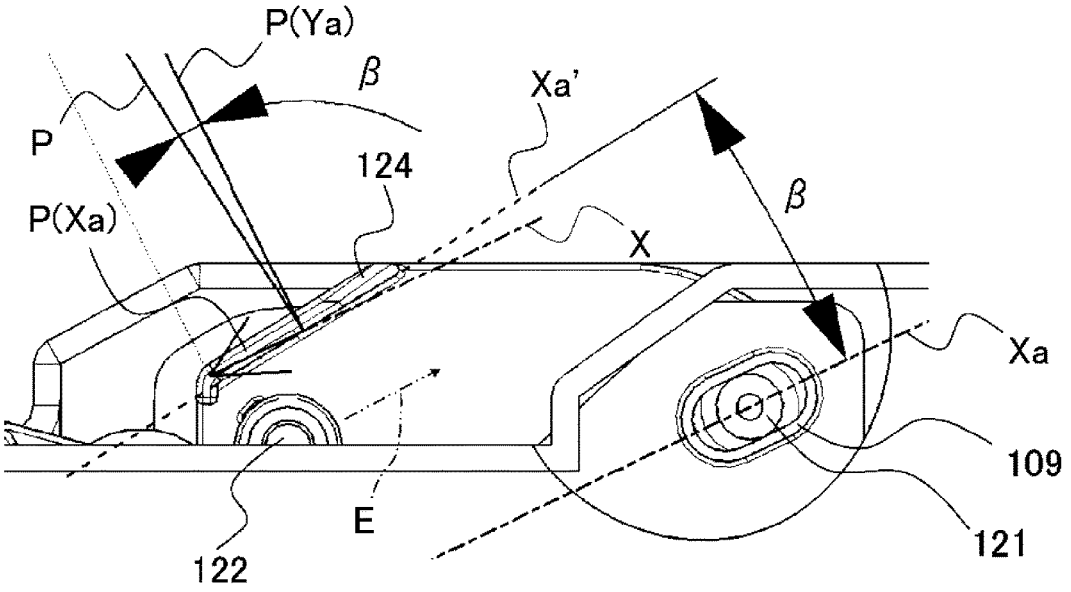

FIG. 14 is a schematic view for illustrating the grip portion shown in FIG. 13.

Figure 15:
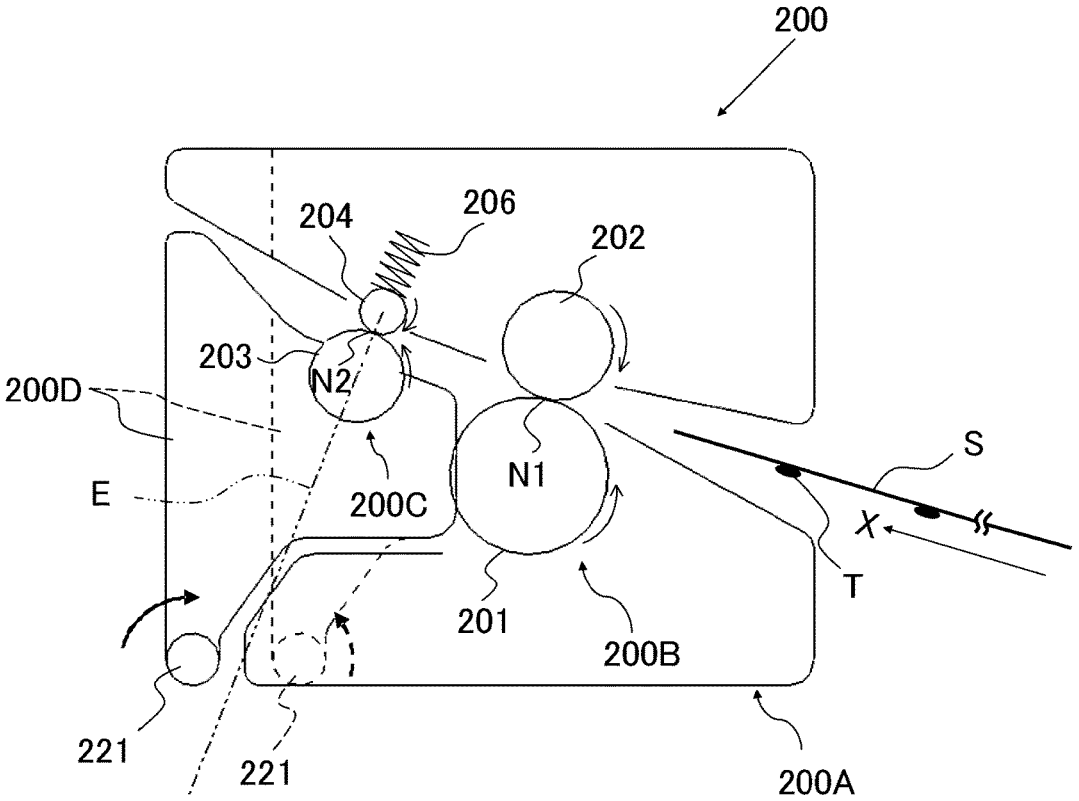
Fig. 15 RELATED ART

FIG. 15 is a sectional view showing a schematic structure of a fixing unit in a comparison example.

DESCRIPTION OF THE EMBODIMENTS

Embodiments of the present invention will be described with reference to the drawings. Although these embodiments are preferred embodiments of the present invention, the present invention is not limited to the following embodiments, but can be replaced with other various constitutions within the scope of the present invention.

Embodiment 1

<Image Forming Apparatus>

Figure 1:
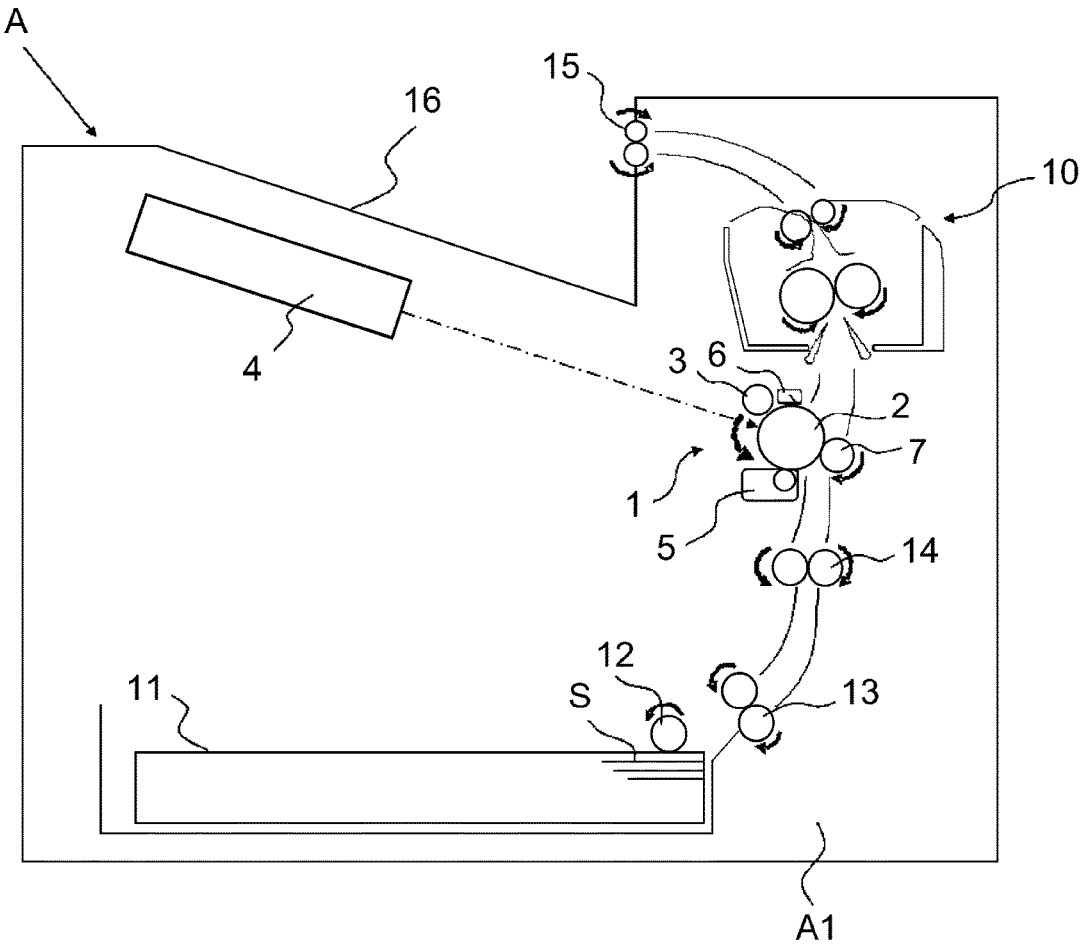
FIG. 1 is a sectional view showing a schematic structure of an image forming apparatus.

With reference to FIG. 1, an image forming apparatus A according to this embodiment will be described. FIG. 1 is a sectional view showing a general structure of an example of the image forming apparatus (a monochromatic printer in this embodiment) A using an electrophotographic recording technique.

In the image forming apparatus A, an image forming portion 1 for forming an image on a recording material S, such as recording paper, includes a photosensitive drum 2 as an image bearing member, a charging member 3, a laser scanner 4, a developing device 5, a cleaner 6 for cleaning an outer peripheral surface of the photosensitive drum 2, and a transfer member 7. An operation of the image forming portion 1 is well known, and, therefore, will be omitted from the detailed description.

The recording material S, such as recording paper accommodated in a cassette 11 in an apparatus main assembly A1 of the image forming apparatus A, is fed one by one through rotation of a roller 12. The recording material S is supplied to a position pair 14 through a roller pair 13. Then, the recording material S is fed to a transfer portion, formed by the photosensitive drum 2 and the transfer member 7, by rotation of the position pair 14, and a toner image is transferred onto the recording material S at the transfer portion. The recording material S carrying an unfixed toner image thereon is sent to a fixing unit 10, and the toner image is heat fixed on the recording material S by the fixing unit 10. The recording material S coming out of the fixing unit 10 is discharged onto a tray 16 by rotation of a roller pair 15.

<Fixing Unit 10>

The fixing unit 10 in this embodiment will be described with reference to FIGS. 2 to 6.

Figure 2:
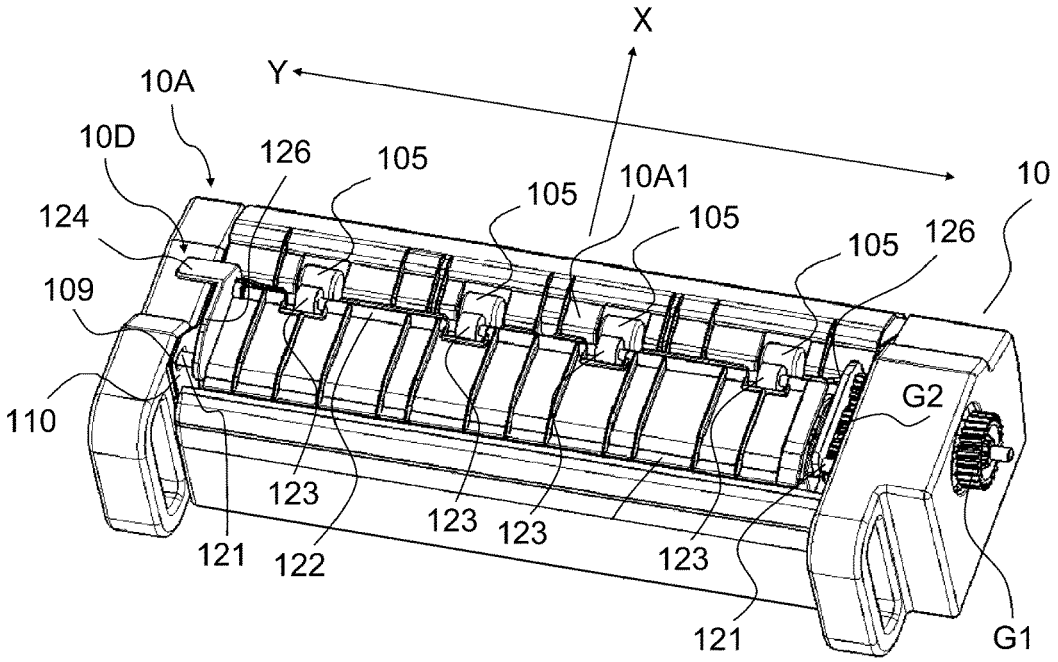
FIG. 2 is a schematic view showing an outer appearance of a fixing unit according to Embodiment 1.
Figure 3:
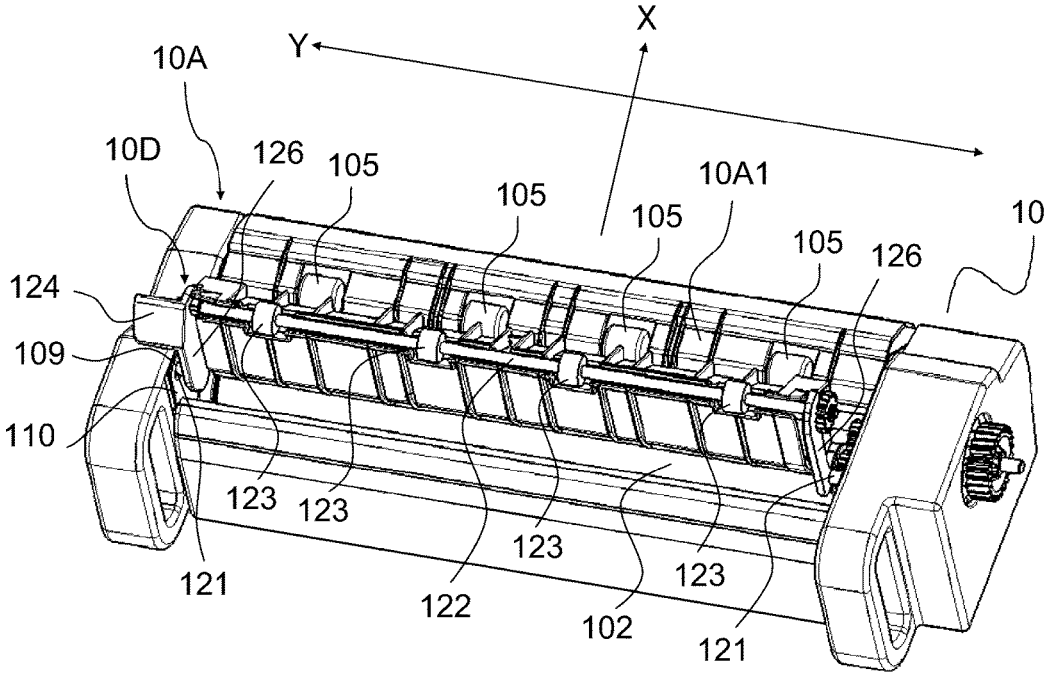
FIG. 3 is a schematic view showing an outer appearance of the fixing unit according to Embodiment 1.

The fixing unit 10 is detachably mountable to the apparatus main assembly A1. FIGS. 2 and 3 are schematic views showing outer appearances of the fixing unit 10 when the fixing unit 10 is demounted.

Figure 4:
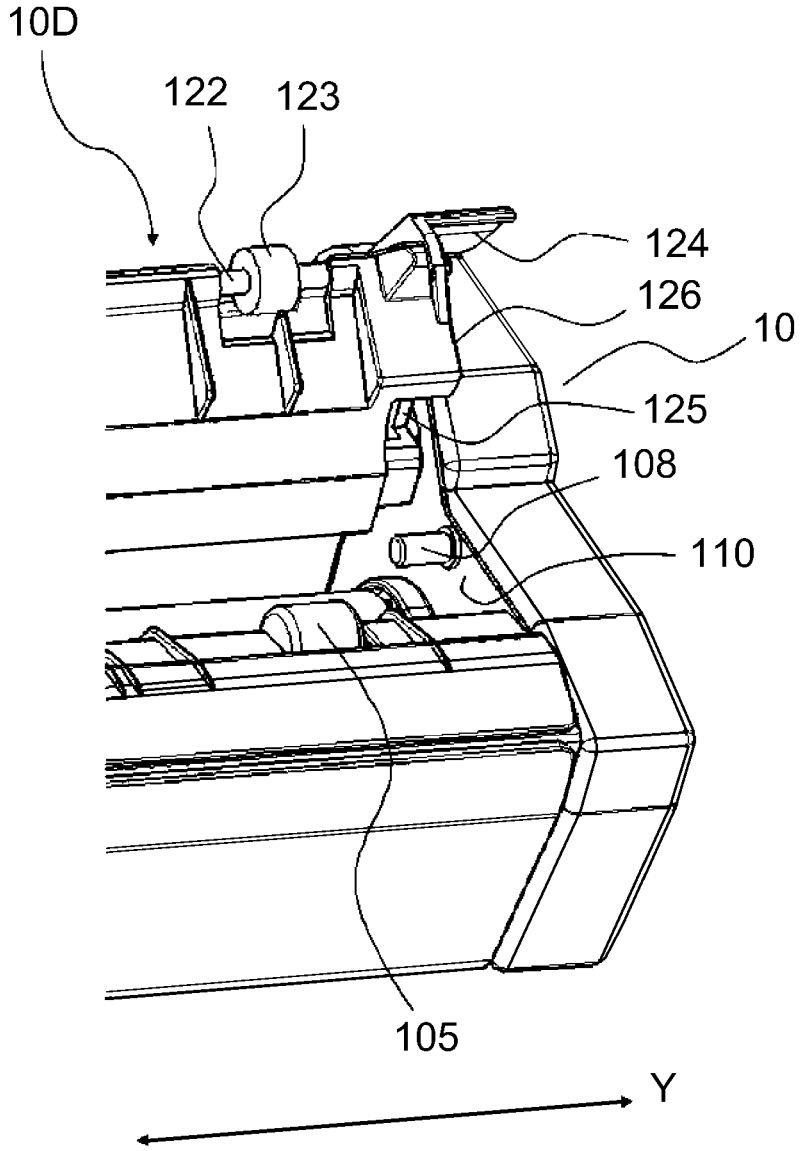
FIG. 4 is a schematic view showing a positioning recessed portion of a guide unit and a positioning shaft of a device main assembly.
Figure 5:
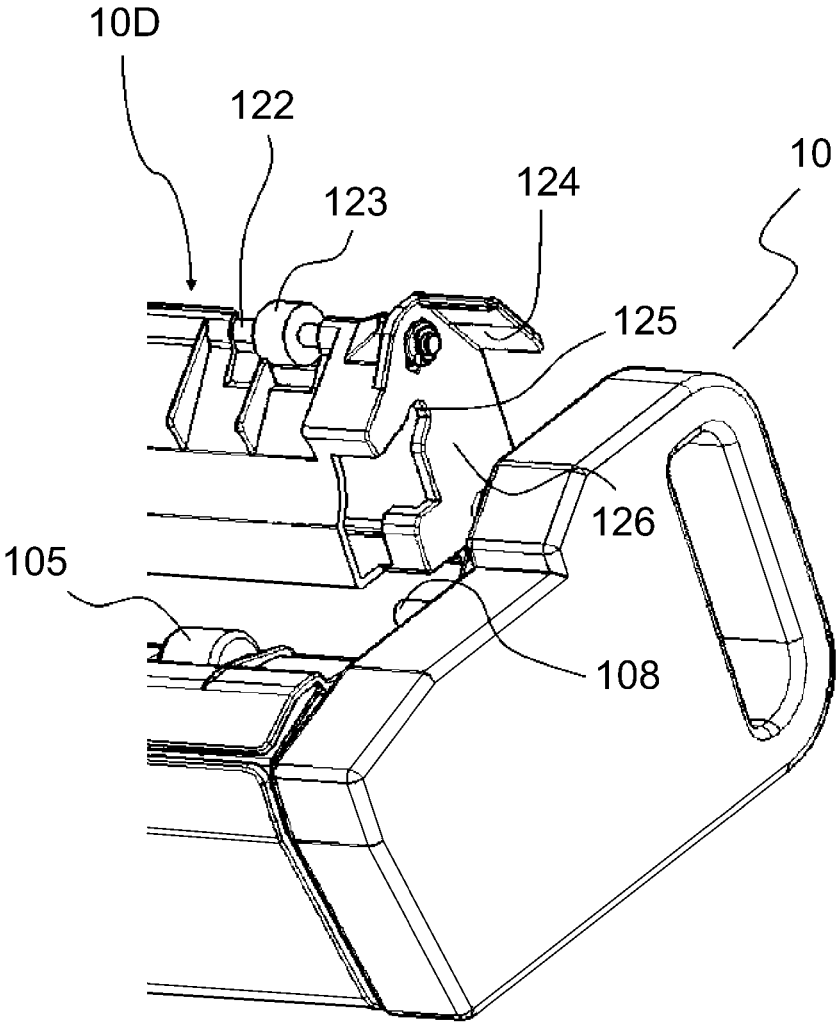
FIG. 5 is a schematic view showing the positioning recessed portion of the guide unit and the positioning shaft of the device main assembly.
Figure 6:
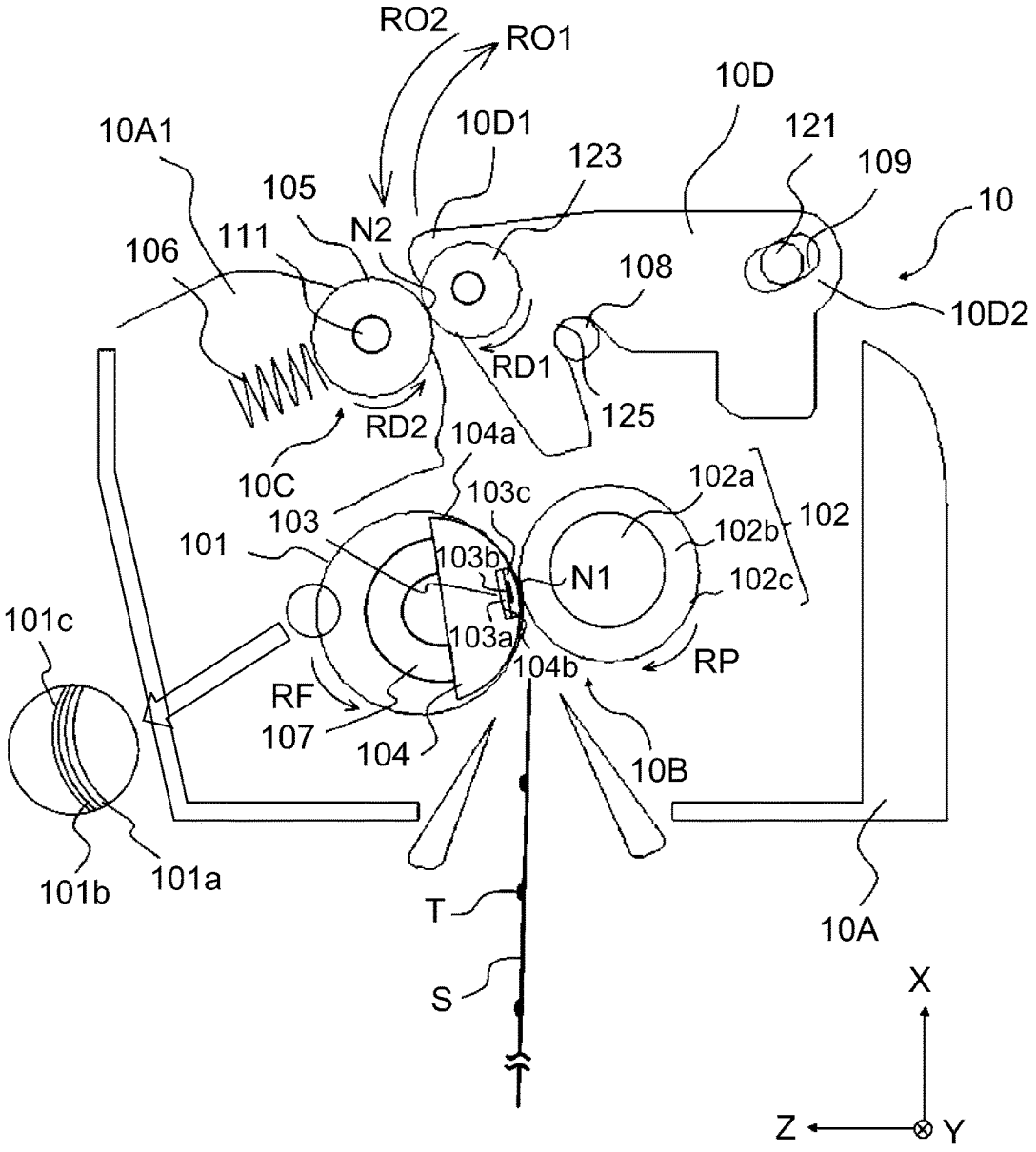
FIG. 6 is a sectional view showing a schematic structure of the fixing unit according to Embodiment 1.

FIG. 2 is a perspective view showing a state in which a guide unit 10D is closed with respect to a device main assembly 10A of the fixing unit 10. FIG. 3 is a perspective view showing a state in which the guide unit 10D is open with respect to the device main assembly 10A of the fixing unit 10. FIG. 4 is a perspective view of a positioning recessed portion 125 of the guide unit 10D and a positioning shaft 108 of the device main assembly 10A in an open state, as seen from an inside of the device main assembly 10A. FIG. 5 is a perspective view of the positioning recessed portion 125 of the guide unit 10D and the positioning shaft 108 of the device main assembly 10A in a closed state, as seen from an outside of the device main assembly 10A. FIG. 6 is a sectional view showing a schematic structure of the fixing unit 10.

As shown in FIG. 6, the fixing unit 10 in this embodiment includes the device main assembly 10A, a fixing portion 10B for fixing the toner image on the recording material S, a feeding portion 10C for feeding the recording material S, and the guide unit 10D, as an openable member, for jam clearance.

The fixing portion 10B includes a cylindrical film 101 as a rotatable heating member and a ceramic heater 103 as a heating source for heating the film 101. The fixing portion 10B further includes a heater holder 104 as a supporting member for not only guiding rotation of the film 101, but also, supporting the heater 103, and includes a stay 107 as a pressing member and a pressing roller 102 as a rotatable pressing member.

The film 101 includes a base layer 101*a* formed in an endless belt shaft with a material having a heat resistant property and flexibility, an elastic layer 101*b* provided on an outer peripheral surface of the base layer 101*a*, and a parting layer 101*c* provided on an outer peripheral surface of the elastic layer 101*b*.

The heater holder 104, inserted into a hollow portion of the film 101, is formed of a heat resistant resin material. The heater holder 104 is supported at both end portions thereof by the device main assembly 10A with respect to a longitudinal direction Y perpendicular to the recording material feeding direction X. The heater holder 104 includes a guiding surface 104*a* for guiding the rotation of the film 101 and supports the heater 103 by a groove 104*b* provided at a central portion of the guiding surface 104*a*.

The heater 103 includes an elongated substrate 103*a* formed of ceramics. On a surface, of the substrate 103*a*, opposing the pressing roller 102, a heat generating resistance layer 103*b* for generating heat by energization is provided along the direction Y. The heat generating resistance layer 103*b* is coated with a glass coating 103*c* as a protective layer for ensuring protection and an insulating property of the heat generating resistance layer 103*b*.

The pressing roller 102 includes a core metal 102*a*, an elastic layer 102*b* provided on an outer peripheral surface of the core metal 102*a*, and a parting layer 102*c* provided on an outer peripheral surface of the elastic layer 102*b*. The pressing roller 102 is rotatably supported at both end portions of the core metal 102*a* by the device main assembly 10A.

The stay 107 prepared with a rigid material, such as metal, is provided on a flat surface portion of the heater holder 104 at the hollow portion of the film 101 on a side opposite from the pressing roller 102. The stay 107 is supported at both end portions thereof by the device main assembly 10A.

Both of the end portions of the stay 107 are urged in a perpendicular direction perpendicular to a generatrix direction of the film 101 by an unshown pressing spring. By an urging force of this pressing spring, the heater holder 104 urges an inner peripheral surface of the film 101. As a result, the outer peripheral surface of the film 101 is press contacted to the outer peripheral surface of the pressing roller 102, so that a nip N1 having a predetermined width is formed by the surfaces of the film 101 and the pressing roller 102.

With respect to the recording material feeding direction X, the feeding portion 10C, provided downstream of the fixing portion 10B, includes a first roller 105 as a first rotatable member and a second roller 123 as a second rotatable member.

The first roller 105 is provided at a projected portion 10A1 provided downstream of the film 101 of the device main assembly 10A with respect to the recording material feeding direction X. As shown in FIGS. 2 and 3, with respect to the direction Y, the projected portion (part of the device main assembly 10A) 10A1 is equidistantly provided with four first rollers 105. A shaft 111 (FIG. 6) supporting the four first rollers 105 is rotatably supported by the projected portion 10A1 through unshown bearings.

The second roller 123 is provided in the guide unit 10D provided downstream of the pressing roller 102. The guide unit 10D is rotatably provided relative to the device main assembly 10A. The second roller 123 is provided at an end portion 10D1 of the guide unit 10D on a side opposing the projected portion 10A1. As shown in FIGS. 2 and 3, the end portion 10D1 is provided equidistantly with four second rollers 123. A shaft 122 supporting the four second rollers 123 is rotatably supported by the end portion 10D1.

The guide unit 10D includes rotation center shafts 121 at both end portions thereof with respect to the direction Y. The rotation center shaft 121 is provided at an end portion 10D2 on a side opposite from the end portion 10D1 of the guide unit 10D with respect to a direction Z. The direction Z is a direction of a horizontal line. As shown in FIGS. 2 and 3, the rotation center shaft 121 is provided on an outside plate 126 of the guide unit 10D.

With respect to the direction Y, at a portion, of the device main assembly 10A, opposing the guide unit 10D, an elongated hole 109, as a bearing portion, is provided. The elongated hole 109 is provided at each of portions, of the device main assembly 10A, opposing both of the end portions of the guide unit 10D, respectively, with respect to the direction Y. The elongated hole 109 is a long hole such that a long axis thereof extends in an urging direction E (FIG. 10) of the spring 106 for urging the first roller 105. As shown in FIGS. 2 and 3, the elongated hole 109 is provided in an inside plate 110, of the device main assembly 10A, opposing the outside plate 126 of the guide unit 10D.

The elongated hole 109 of the device main assembly 10A rotatably supports the rotation center shaft 121 of the guide unit 10D. As a result, the guide unit 10D is openable about the rotation center shaft 121 thereof in directions of arrows RO1 and RO2, shown in FIG. 6, relative to the device main assembly 10A.

A user opens the guide unit 10D relative to the device main assembly 10A for performing jam clearance in a case when a jam occurs in the device main assembly 10A.

The device main assembly 10A includes, with respect to the direction Y, a positioning shaft 108 as an engaging portion on one side thereof. As shown in FIGS. 4 and 5, with respect to the direction Y, the positioning shaft 108 is provided on the inside plate 110 of the device main assembly 10A.

The guide unit 10D includes, with respect to the direction Y, the positioning recessed portion 125 as a portion to be engaged on one side thereof. The positioning recessed portion 125 is provided between the second roller 123 and the rotation center shaft 121 with respect to the direction Z. As shown in FIGS. 4 to 6, the positioning recessed portion 125 is provided on the outside plate 126 of the guide unit 10D and is open toward the pressing roller 102.

When the guide unit 10D is opened relative to the device main assembly 10A, the positioning recessed portion 125 is spaced from the positioning shaft 108. When the guide unit 10D is closed relative to the device main assembly 10A, the positioning recessed portion 125 moves with the positioning shaft 108.

When the guide unit 10D is closed relative to the device main assembly 10A, the second roller 123 contacts the first roller 105, so that a nip N2 (FIG. 6) is formed by the surfaces of the second roller 123 and the first roller 105. Here, the first roller 105 is urged, by the spring 106 as an urging member, in a direction perpendicular to the generatrix direction of the first roller 105. The urging direction of the first roller 105 by the spring 106 will be described later.

<Heat Fixing Process Operation>

A gear G1 provided at one end of the device main assembly 10A shown in FIG. 2 is rotated by an unshown motor. Then, rotation (rotational force) of the gear G1 is transmitted to the core metal 102*a* of the pressing roller 102 of the fixing portion 10B and the shaft 122 of the second roller 123 of the feeding portion 10C through a gear train G2 provided in the device main assembly 10A.

As a result, the pressing roller 102 is rotated in an arrow RP direction shown in FIG. 6, and the film 101 is rotated in an arrow RF direction shown in FIG. 6 by rotation of the pressing roller 102. The second roller 123 is rotated in an arrow RD1 direction shown in FIG. 6, and the first roller 105 is rotated in an arrow RD2 direction shown in FIG. 6 by rotation of the second roller 123.

When electrical power is supplied from an unshown power source to the heat generating resistance layer 103*b* of the heater 103, the heat generating resistance layer 103*b* generates heat, so that the heater 103 is abruptly increased in temperature. An unshown controller acquires a detection temperature, of the film 101, detected by a thermistor, and controls an amount of energization to the heat generating resistance layer 103*b* so as to maintain the detection temperature at a predetermined fixing temperature (target) temperature.

The recording material S carrying the unfixed toner image T thereon is heated by being nipped and fed through the nip N1, whereby the toner image T is fixed on the recording material S.

The feeding portion 10C sends the recording material S, fed from the fixing portion 10B, to the roller pair 15 of the apparatus main assembly A1 by nipping and feeding the recording material S through the nip N2.

<Closing Operation of Guide Unit 10D>

An operation of closing the guide unit 10D relative to the device main assembly 10A will be described with reference to FIGS. 7 to 10. FIGS. 7 to 10 are schematic views showing a rotation locus of the guide unit 10D when the guide unit 10D is closed.

Figure 7:
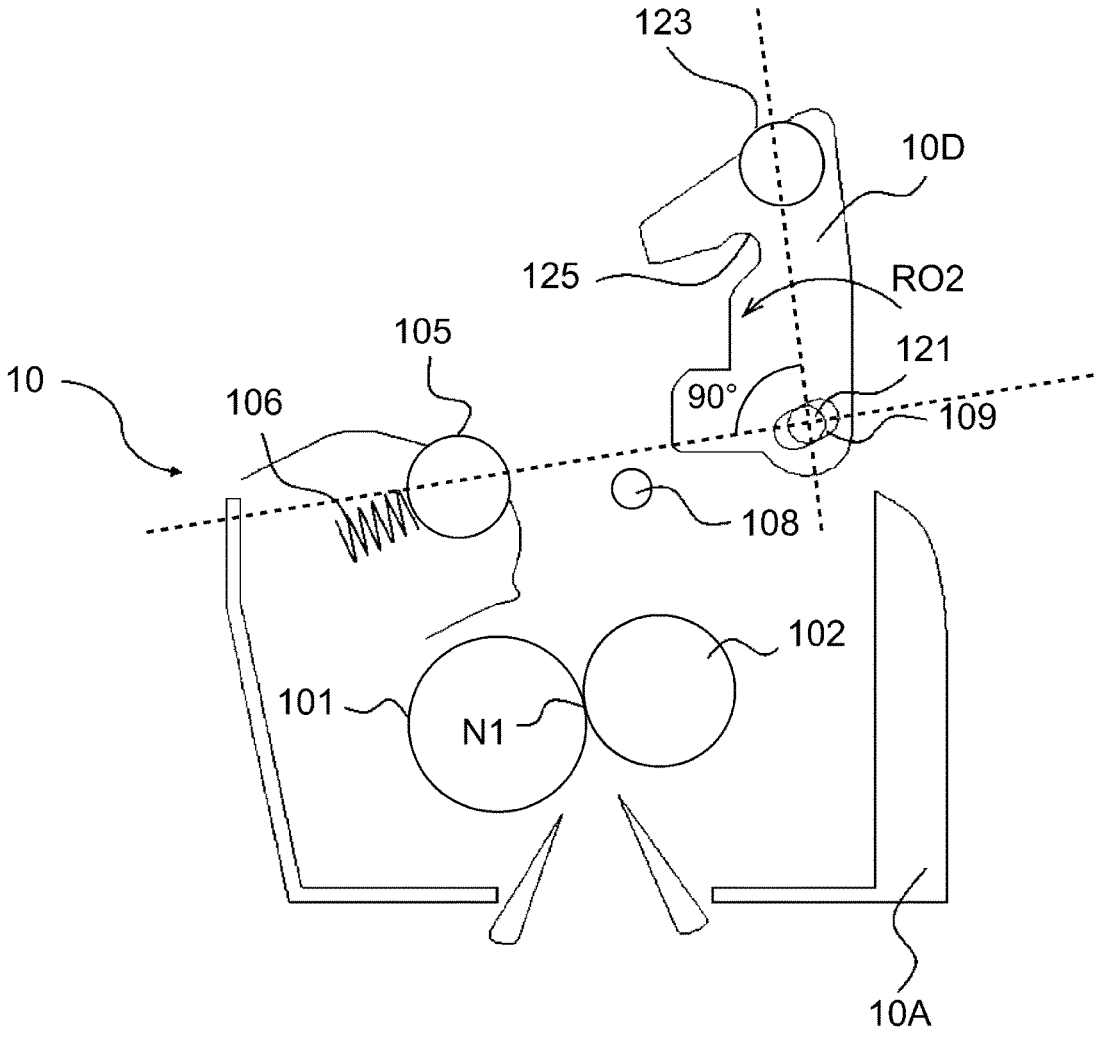
FIG. 7 is a sectional view showing a schematic structure of the fixing unit when an open angle of the guide unit is ninety degrees.

(1) Guide Unit Open Angle of Ninety Degrees (FIG. 7)

A guide unit open angle of ninety degrees is an angle used during jam clearance. When the open angle is ninety degrees, the positioning recessed portion 125 of the guide unit 10D is spaced from the positioning shaft 108 of the device main assembly 10A.

Figure 8:
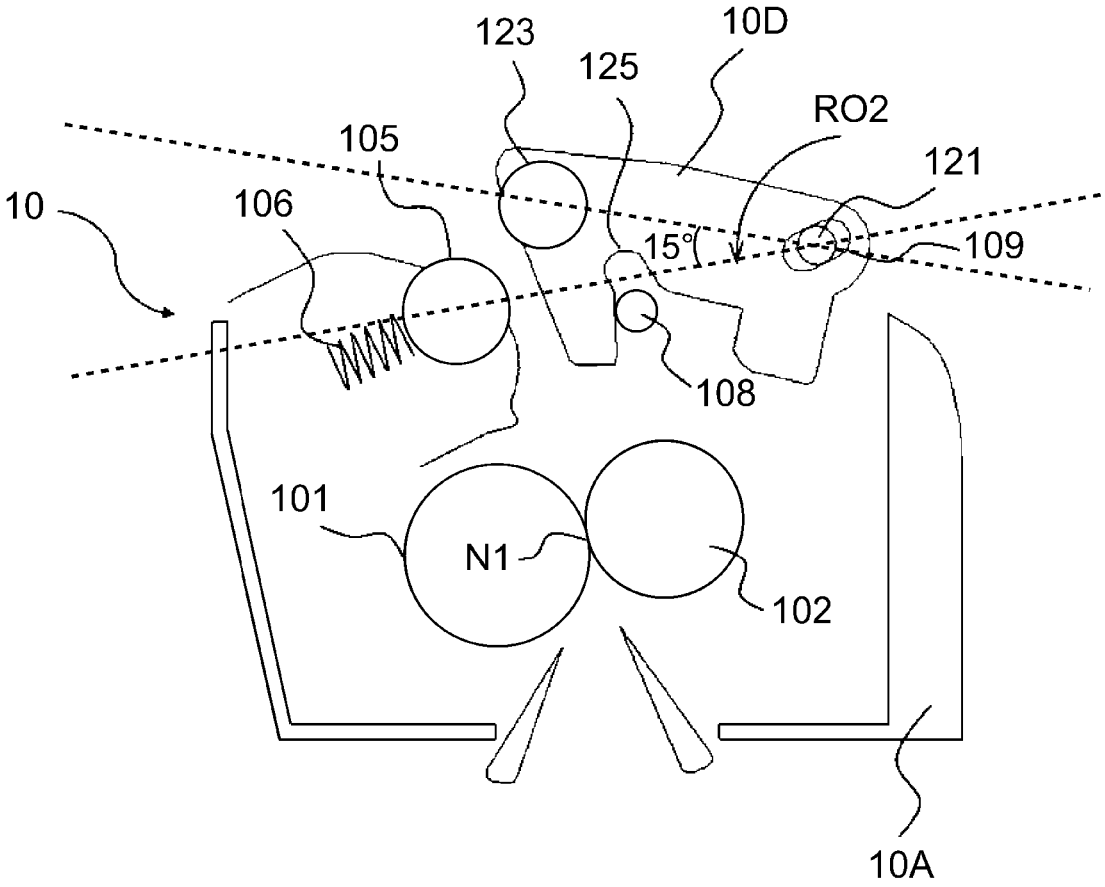
FIG. 8 is a sectional view showing a schematic structure of the fixing unit when the open angle of the guide unit is fifteen degrees.

(2) Guide Unit Open Angle of Fifteen Degrees (FIG. 8)

When the guide unit 10D is closed from the open angle of ninety degrees to an open angle of fifteen degrees, the positioning recessed portion 125 of the guide unit 10D contacts the positioning shaft 108 of the device main assembly 10A.

(3) Guide Unit Open Angle of Five Degrees (Parts (a) and (b) of FIG. 9)

The guide unit 10D is closed from the open angle of fifteen degrees to an open angle of five degrees. Then, as shown in part (a) of FIG. 9, at an arrow A portion, the positioning shaft 108 of the device main assembly 10A and a shaft introducing portion 125*a* of the positioning recessed portion 125 of the guide unit 10D interfere with each other. For that reason, when the guide unit 10D is further closed, as shown in part (b) of FIG. 9, the guide unit 10D is closed while being moved in an obliquely leftward and downward direction (direction SG) in the figure.

(4) Guide Unit Open Angle of Zero Degrees (FIG. 10)

The guide unit 10D is closed from less than five degrees to an open angle of zero degrees. Then, the surface of the second roller 123 of the guide unit 10D contacts the surface of the first roller 105 of the device main assembly 10A. At this time, the first roller 105 urged by the spring 106 in a direction shown by an arrow E urges the second roller 123 in the same direction. As a result, the guide unit 10D is moved in an obliquely rightward and upward direction (direction RSG), and the positioning shaft 108 and the positioning recessed portion 125 engage with each other, so that a position of the guide unit 10D is determined.

At this time, with respect to the urging direction E of the spring 106, a gap C is provided between the rotation center shaft 121 and the end portion 109*a* of the elongated hole 109, so that the rotation center shaft 121 does not abut against the end portion 109*a* on a side of an end of the urging direction E of the spring 106. Thus, by providing the gap C, compared with the case when the rotation center shaft 121 is abutted against the end portion 109*a* of the elongated hole 109, an urging force F, of the spring 106, exerted on the rotation center shaft 121, decreases.

For that reason, it becomes possible to decrease a moment M (=F×L) when the guide unit 10D is opened about the rotation center shaft 121. Here, L is a distance between the urging force F of the spring 106 and a center of the rotation center shaft 121.

Further, in order that the guide unit 10D can be opened by the moment M, the rotation center shaft 121 is provided upstream of the nip N2 with respect to the recording material feeding direction X when the recording material S is nipped and fed through the nips N1 and N2. For that reason, compared with the case when the rotation center shaft 121 is provided downstream of the nip N2, a size of the fixing unit 10 can be reduced.

Further, when the guide unit 10D is intended to be opened by the moment M, as shown in part (a) of FIG. 9, the positioning shaft 108 and the shaft introducing portion 125*a* of the positioning recessed portion 125 interfere with each other. As a result, in order to open the guide unit 10D by the moment M, a force for elastically deforming the rotation center shaft 108 in the urging direction E of the spring 106 is needed, and the force is a retaining force for retaining the guide unit 10D against the moment M.

The force for opening the guide unit 10D by the moment M is small as described above, and, therefore, the following formula (1) is satisfied.

$$\text{(Force for opening guide unit 10}D\text{ by moment }M\text{)} < \text{(Retaining force)} \quad (1)$$

As a result, the guide unit 10D is not opened by the urging force F of the spring 106.

Embodiment 2

Another embodiment of the fixing unit 10 will be described. In this embodiment, only a constitution different from the constitution of Embodiment 1 will be described.

The fixing unit 10 in this embodiment includes the rotation center shaft 121 provided in the device main assembly 10A and the elongated hole 109 provided in the guide unit 10D. Also, in the fixing unit 10 in this embodiment, an effect similar to that of Embodiment 1 is obtained.

Embodiment 3

Another embodiment of the fixing unit 10 will be described. In this embodiment, only a constitution different from the constitution of Embodiment 1 will be described.

FIG. 11 is a sectional view showing a schematic structure of the fixing unit 10 according to this embodiment. FIG. 12 is an enlarged view of a region indicated by a chain double dashed line in FIG. 11.

In the fixing unit 10 in this embodiment, as shown in FIG. 11, when the guide unit 10D is closed relative to the device main assembly 10A to the open angle of five degrees, the rotation center shaft 121 is contacted to the end portion 109*b*, of the elongated hole 109, toward a direction E' opposite to the urging direction E of the spring 106. Further, as shown in FIG. 12, the positioning shaft 108 of the device main assembly 10A and the shaft introducing portion 125*a* of the positioning recessed portion 125 of the guide unit 10D are caused to interfere with each other.

As a result, in a range in which the condition of the formula (1) described in Embodiment 1 is satisfied, the guide unit 10D is opened and closed while elastically deforming an entirety of the guide unit 10D, and, therefore, the user can obtain a click feeling. Further, even when the fixing unit 10 is demounted from the apparatus main assembly A1 and is reversed by one hundred eighty degrees and, thus, the guide unit 10D is turned upside down, the guide unit 10D is not opened, and, therefore, usability can be improved.

A member to be elastically deformed when the guide unit 10D is opened and closed is not limited to the entirety of the guide unit 10D. For example, a predetermined region, where the positioning recessed portion 125 for positioning the guide unit 10D is provided, is subjected to a rigidity lowering process, so that the region may also be made elastically deformable. Alternatively, the rotation center shaft 121 provided on the guide unit 10D or the device main assembly 10A is subjected to the rigidity lowering process thereof, so that the rotation center shaft 121 may also be made elastically deformable.

Embodiment 4

Another embodiment of the fixing unit 10 will be described. In this embodiment, only a constitution different from the constitution of Embodiment 1 will be described.

As shown in FIGS. 2, 3, 13, and 14, the guide unit 10D includes a grip portion 124 for opening and closing the guide unit 10D relative to the device main assembly 10A.

FIG. 13 is a side view of the fixing unit 10 on a side where the grip portion 124 is provided. FIG. 14 is a schematic view for illustrating the grip portion 124 shown in FIG. 13.

As shown in FIGS. 13 and 14, a long axis direction of the elongated hole 109 is Xa, and a direction of a handholding portion of the grip portion 124 of the guide unit 10D is Xa'. When the guide unit 10D is opened, a load exerted on the grip portion 124 by the user and a direction thereof are P (perpendicular to Xa'), a component force (load) of the load P with respect to the Xa direction is P(Xa), and a component force (load) of the load P with respect to a direction perpendicular to the Xa direction is P (Ya). A direction of the component force P (Xa) is such that an angle β formed between Xa and Xa' so that the component force F (Xa) extends toward an obliquely leftward and downward direction in the figures. That is, a shape of the grip portion 124 is such that the component force P (Xa) of the load force P when the guide unit 10D is opened acts in the direction opposite to the urging direction E of the spring 106.

As a result, when the user opens the guide unit 10D, the guide unit 10D is opened while moving in the obliquely leftward and downward direction, and, therefore, an interference amount between the positioning shaft 108 and the positioning recessed portion 125 is reduced, so that the guide unit 10D can be smoothly opened.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A fixing unit comprising:

a fixing portion, including a rotatable heating member and a rotatable pressing member to form a first nip in cooperation with said rotatable heating member, to fix an image on a recording material by heating the recording material carrying the image, while nipping the recording material, at the first nip, and feeding the recording material in a recording material feeding direction;

a feeding portion, provided downstream of said fixing portion with respect to the recording material feeding direction, and including a first rotatable member and a second rotatable member to form a second nip, in cooperation with said first rotatable member, to nip and to feed the recording material fed from said fixing portion;

a main assembly rotatably supporting said rotatable heating member, said rotatable pressing member, and said first rotatable member;

an openable member, rotatably supporting said second rotatable member, and rotatably supported on said main assembly by a shaft and a bearing portion supporting said shaft, wherein, when said openable member is opened relative to said main assembly, said second rotatable member is spaced from said first rotatable member, and, when said openable member is closed relative to said main assembly, said second rotatable member contacts said first rotatable member;

an urging member provided in said main assembly and configured to urge said first rotatable member toward said second rotatable member along an urging direction, wherein said bearing portion includes an elongated hole having a long axis extending along the urging direction of said urging member;

an engaging portion provided in said main assembly; and a portion-to-be-engaged provided on said openable member, wherein said portion-to-be-engaged is spaced from said engaging portion when said openable member is opened, and is engaged with said engaging portion when said openable member is closed, wherein said shaft and said bearing portion are provided at a position at which a direction of moment acting on said openable member by an urging force of said urging member is the same as a direction in which said openable member opens.

2. A fixing unit according to claim 1, wherein, when said engaging portion and said portion-to-be-engaged engage with each other, a gap is formed between said shaft and a downstream end portion of the elongated hole with respect to the urging direction.

3. A fixing unit according to claim 2, wherein, when said openable member is closed relative to said main assembly, said shaft is in contact with an upstream end portion of the elongated hole with respect to the urging direction.

4. A fixing unit according to claim 1, wherein said openable member includes said shaft, and said main assembly includes said bearing portion.

5. A fixing unit according to claim 1, wherein said openable member includes said bearing portion, and said main assembly includes said shaft.

6. A fixing unit according to claim 1, wherein said openable member is openable relative to said main assembly by elastic deformation of said openable member, in a state in which said engaging portion and said portion-to-be-engaged engage with each other.

7. A fixing unit according to claim 1, wherein said openable member includes a grip portion configured to open and to close said openable member, and wherein a shape of said grip portion is such that a component, with respect to a direction parallel to the long axis direction of the elongated hole, of a force acting on said grip portion, when said openable member is opened, acts in a direction opposite to the urging direction.

8. An image forming apparatus comprising:

an image forming unit configured to form an image on a recording material;

a fixing unit configured to fix the image, formed on the recording material, onto the recording material, wherein said fixing unit is said fixing unit according to claim 1.

9. A fixing unit comprising:

a rotatable heating member;

a rotatable pressing member configured to form a nip in cooperation with said rotatable heating member and to fix an image on a recording material by heating the recording material carrying the image, while nipping the recording material, at the nip; and feeding the recording material in a recording material feeding direction;

a main assembly rotatably supporting said rotatable heating member and said rotatable pressing member;

an openable member rotatably supported on said main assembly by a shaft and a bearing portion supporting said shaft;

an urging member provided in said main assembly and configured to urge said openable member along an urging direction; wherein said bearing portion includes an elongated hole having a long axis extending along the urging direction of said urging member;

an engaging portion provided in said main assembly; and a portion-to-be-engaged provided on said openable member; wherein said portion-to-be-engaged is spaced from said engaging portion when said openable member is opened, and is engaged with said engaging portion when said openable member is closed, wherein said shaft and said bearing portion are provided at a position closer to said rotatable pressing member than is a phantom line extending from said urging member in the urging direction.

10. A fixing unit according to claim 9, further comprising a feeding portion, provided downstream of the nip with respect to the recording material feeding direction, and including a first rotatable member and a second rotatable member to form a second nip, in cooperation with said first rotatable member, to nip and to feed the recording material fed from the nip, wherein said first rotatable member is supported on said main assembly and said second rotatable member is supported on said openable member, wherein, when said openable member is opened relative to said main assembly, said second rotatable member is spaced from said first rotatable member, and, when said openable member is closed relative to said main assembly, said second rotatable member contacts said first rotatable member, and wherein said urging member urges said first rotatable member toward said second rotatable member.

11. A fixing unit according to claim 9, wherein, when said engaging portion and said portion-to-be-engaged engage with each other, a gap is formed between said shaft and a downstream end portion of the elongated hole with respect to the urging direction.

12. A fixing unit according to claim 11, wherein, when said openable member is closed relative to said main assembly, said shaft is in contact with an upstream end portion of the elongated hole with respect to the urging direction.

13. A fixing unit according to claim 9, wherein said openable member includes said shaft, and said main assembly includes said bearing portion.

14. A fixing unit according to claim 9, wherein said openable member includes said bearing portion, and said main assembly includes said shaft.

15. A fixing unit according to claim 9, wherein said openable member is openable relative to said main assembly by elastic deformation of said openable member, in a state in which said engaging portion and said portion-to-be-engaged engage with each other.

16. A fixing unit according to claim 9, wherein said openable member includes a grip portion configured to open and to close said openable member, and wherein a shape of said grip portion is such that a component, with respect to a direction parallel to the long axis direction of the elongated hole, of a force acting on said grip portion, when said openable member is opened, acts in a direction opposite to the urging direction.

17. An image forming apparatus comprising:

an image forming unit configured to form an image on a recording material;

a fixing unit configured to fix the image, formed on the recording material, onto the recording material, wherein said fixing unit is said fixing unit according to claim 9.

* * * * *